United States Patent [19]

Lundell

[11] 4,182,510

[45] Jan. 8, 1980

[54] EXERCISE SHOE SIT-UP APPARATUS

[76] Inventor: Robert C. Lundell, 2044 Western Ave. North, Roseville, Minn. 55113

[21] Appl. No.: 937,191

[22] Filed: Aug. 21, 1978

[51] Int. Cl.[2] ..... A63B 23/02

[52] U.S. Cl. ..... 272/93; 272/900

[58] Field of Search ..... 272/93, 143, 144, 145, 272/900

[56] References Cited

U.S. PATENT DOCUMENTS

| | | | |
|---|---|---|---|
| 1,456,317 | 5/1923 | Lauer | 272/145 |
| 1,905,019 | 4/1933 | Turner | 272/900 |
| 2,046,653 | 7/1936 | Petcoff | 272/144 |
| 2,050,652 | 8/1936 | Fleming | 272/93 |
| 2,425,971 | 8/1947 | Walker | 272/900 |
| 3,134,592 | 5/1964 | Sharkey | 272/900 X |
| 3,913,907 | 10/1975 | Baker | 272/93 |
| 4,116,434 | 9/1978 | Bernstein | 272/93 |

*Primary Examiner*—Richard J. Johnson

*Attorney, Agent, or Firm*—Orrin M. Haugen; Thomas J. Nikolai

[57] ABSTRACT

A foot restraining device for use during sit-up exercises. A rectangular platform which is tilted downward at a predetermined angle from its rear edge to its front edge is provided at its front edge with upwardly projecting, spaced apart jaws designed to straddle the bottom edge of a room door. A strap is used to bind the user's foot to the platform so that as he performs a sit-up, his foot is prevented from rising upwardly.

4 Claims, 3 Drawing Figures

EXERCISE SHOE SIT-UP APPARATUS

BACKGROUND OF THE INVENTION

I. Field of the Invention

This invention relates generally to apparatus for facilitating the performance of body-conditioning exercises, and more specifically to a foot restraining device or exercise shoe which aids in the performance of sit-ups.

II. Description of the Prior Art

The closest prior art of which I am aware is the device described in the Fleming U.S. Pat. No. 2,050,652. This device comprises a bracket member formed from sheet steel and having a vertical portion disposed between a horizontal base flange and an upper flanged member. The base member is adapted to fit between the floor of a room and the bottom of a door with the vertical portion thereof abutting the lower side surface of the door. An arrangement of clamping screws is provided for holding the bracket in place. Furthermore, teeth-like projections on the base flange penetrate the underside edge of the door to hold the bracket in place. A strap is provided which is adapted to pass around the ankles of the user, the strap being fastened to the upper flange. In use, during a sit-up exercise, the person's legs are restrained from lifting upward as the user moves from a supine position to a sitting position.

This prior art device of the Fleming patent has a number of inherent drawbacks. First of all, its use necessarily causes damage to the door member in that it is intended to penetrate the wood. After repeated uses, the door would tend to become so perforated that splintering thereof may result. Furthermore, the device requires the adjustment of at least four clamping screws when installing the unit to a door. Since these clamping screws are intended to react with a hard floor surface, it is believed that the device will not function properly on a carpeted surface. More importantly, the device of the Fleming patent cannot be utilized when doing sit-ut exercises with the legs bent at the knees, which is the present day recommended position to assume while doing this exercise. If one were to attempt to assume the bent-knee position while utilizing the Fleming apparatus, the user's foot will abut the sharp edge of the other flange causing considerable discomfort to the soles of the user's feet.

SUMMARY OF THE INVENTION

In accordance with the teachings of my invention, I provide a foot restraining device which cooperates with the bottom edge of a room door, but which does not require clamping screws or spikes for engaging the door. Instead, a U-shaped channel having spaced apart legs may be slid under the bottom edge of the door with the legs engaging opposed side surfaces thereof proximate the bottom edge of the door. An integrally formed platform extends upwardly and rearwardly from the aforementioned channel and provides a comfortable surface on which the soles of the user's feet may rest. The angle of inclination of this platform corresponds to the natural angle which the soles of the feet would assume when the user is lying on his back with his knees bent. Furthermore, the platform is designed to be longer than the foot of the user so as to provide support over the entire sole surface of the foot. The platform is suitably slotted to accept a restraining strap which passes over the bridge of the user's foot, rather than about his ankles as in the Fleming arrangement.

OBJECTS

It is accordingly the principal object of the present invention to provide a new and improved exercise shoe for facilitating the performance of sit-up exercises.

Another object of the invention is to provide a foot restraining device for use during sit-up exercises which may be readily mounted on the bottom edge of a room door without damage thereto and without the need for additional clamping members.

Yet another object of the invention is to provide a foot restraining device for use during sit-up exercises which allows the user to perform such exercises with his knees in a bent position.

These and other objects and advantages of the invention will become apparent to those skilled in the art from the following detailed description of the preferred embodiment and the accompanying drawings in which corresponding parts in the several views bear the same identifying numeral.

DESCRIPTION OF THE PREFERRED EMBODIMENT

Figure 1:
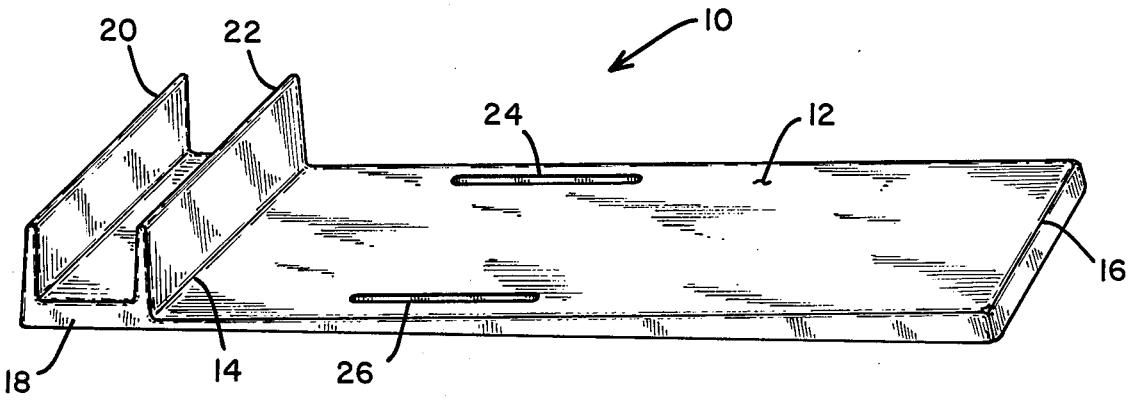
FIG. 1 is a perspective view of the exercise shoe of the present invention.

Referring first to FIG. 1, there is indicated generally by numeral 10 the exercise show or foot restraining device comprising the preferred embodiment of this invention. The device comprises a platform member 12 which is generally rectangular in shape and having a front edge 14 and a rear edge 16. As can be seen from the perspective view of FIG. 1, the height of the platform member at its front edge 14 is less than its height at its rear edge 16 so that the major surface of the platform 12 is inclined upwardly at a predetermined angle from its front edge to its rear edge. The device 10 is preferably fabricated from a suitable thermosetting plastic as by molding and it has proximate its front edge 14 an integrally formed, transversely extending channel portion indicated generally by numeral 18. The channel 18 is comprised of a pair of upwardly projecting, parallel and spaced apart ribs 20 and 22, the spacing therebetween being such as to accept the thickness dimension of a conventional room door. For example, the spacing between the opposing side surfaces of the ribs 20 and 22 may be approximately 1.625 inches which is found to accommodate most door sizes.

The overall length of the exercise shoe of FIG. 1 may be about 13.25 inches, but this dimension is not deemed critical. Spaced rearwardly of the front edge 14 and proximate opposed side edges of the platform 12 are elongated slots 24 and 26 adapted to receive a flexible strap.

Figure 2:
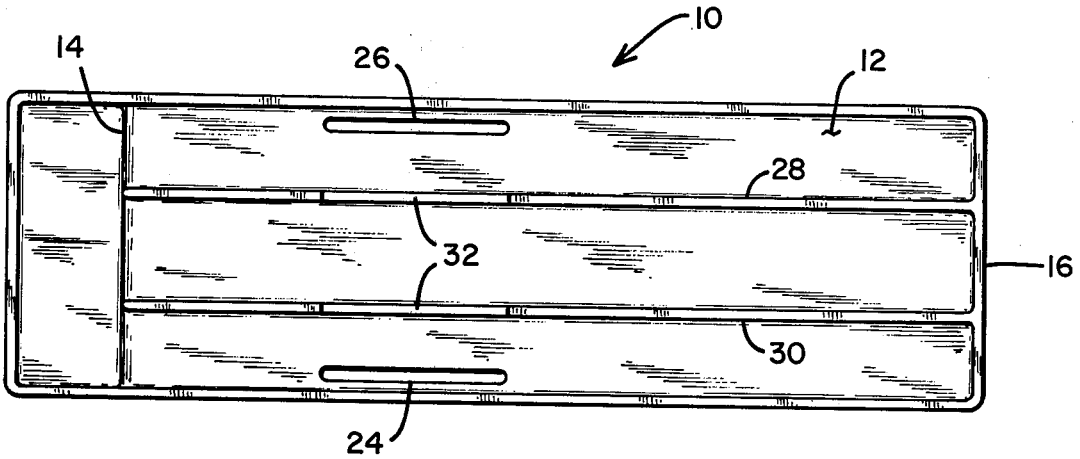
FIG. 2 is a view of the underside of the preferred embodiment showing the reinforcing ribs.

With reference to FIG. 2 which shows the underside of the exercise shoe 10, it can be seen that first and second reinforcing ribs 28 and 30 are provided which extend longitudinally from the front edge portion 14 to the rear edge portion 16. These reinforcing ribs 28 and 30 are notched as at 32 so that the strap may pass through the slots 24 and 26 and through these notches, allowing the platform to rest on the floor with the bottom edge of the platform side surfaces and the reinforcing ribs contacting the floor.

Figure 3:
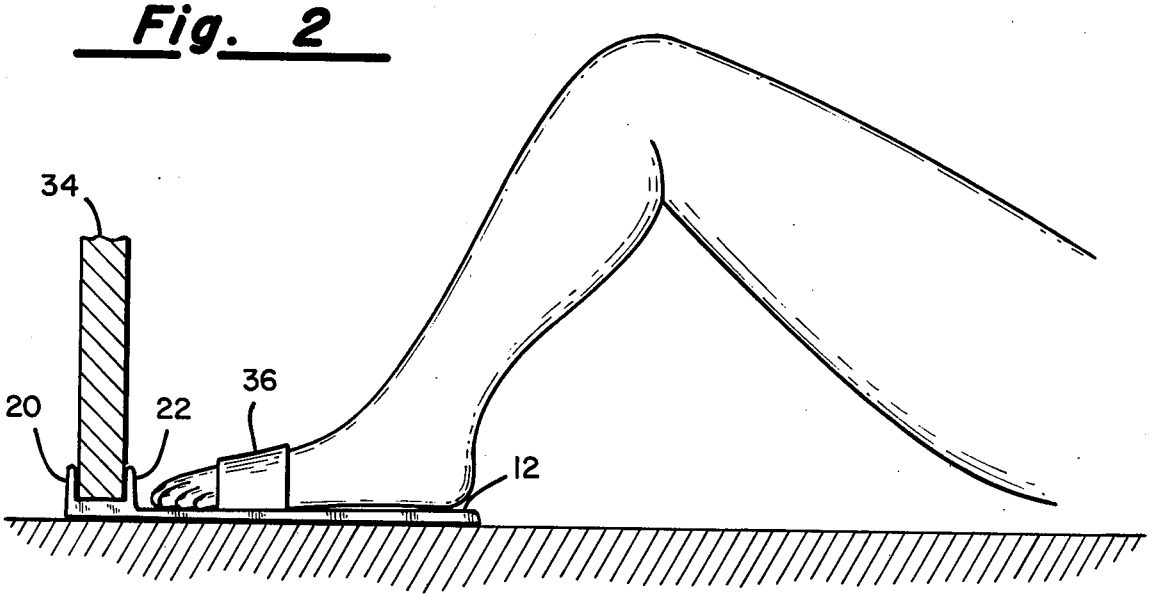
FIG. 3 is a side elevation showing the device as it is used.

Referring now to FIG. 3, the manner of using the foot restraining device of the present invention will be described. As is illustrated, the exercise shoe 10 is positioned about a door 34 with the ribs 20 and 22 abutting opposed side surfaces thereof. The door is then closed such that its latch is engaged. The user places a foot on the platform 12 and fastens the strap 36 such that the sole of the foot remains in contact with the platform 12. He then reclines on the floor with his knee bent as illustrated in FIG. 3. He may then begin his sit-up exercises and his feet will be restrained from moving upward as his upper torso is brought into a sitting position.

While various forms of fasteners may be used on the strap 36, it is found that a Velcro-type connection is very convenient and well suited to this application.

As was earlier mentioned, it is preferable that the top surface of the platform 12 be inclined from its front edge to its rear edge. It has been found that the rear edge is approximately ¼ inch higher at its rear edge than at its front edge, it readily conforms to the angle which a foot comfortably assumes when a person is reclining on the floor with his knees bent. Similarly, the platform may have a width of between four and five inches and a length of between eleven and twelve inches between its front edge 14 and its rear edge 16. As such, the overall length of the entire exercise shoe is between thirteen and fourteen inches when the door engaging portion thereof is included.

While various changes may be made in the specific structure disclosed, it shall be understood that such changes shall be within the spirit and scope of the present invention as defined by the following claims.

What is claimed is:

1. A foot restraining device for use during sit-up exercises comprising:

(a) a platform member having a front edge, a rear edge and two generally parallel longitudinally extending side portions integrally formed therewith and projecting generally perpendicular thereto, said side portions being higher proximate said rear edge than at said front edge, such that said platform member is inclined upward by a predetermined angle from said front edge to said rear edge when said side portions are resting on a floor;

(b) first and second parallel and spaced apart ribs integrally formed with and extending upward from said platform member proximate said front edge thereof for engaging the bottom edge of a door on opposed sides thereof;

(c) a pair of slots formed through said platform member and extending parallel to said side portions; and (d) a strap passing through said pair of slots for engaging the bridge of a user's foot to bind said foot to said platform member with the heel and ball of said foot resting on said platform member.

2. The foot restraining device as in claim 1 and further including:

(a) first and second longitudinally extending spaced reinforcing ribs formed on the underside of said platform member and extending parallel to said side portions.

3. Apparatus as in claim 2 wherein said foot restraining device is molded from a thermosetting plastic material.

4. Apparatus as in claim 3 wherein the width of said platform member is between four inches and five inches, the length of said platform member is between thirteen inches and fourteen inches, and the height of said platform member is about 0.25 inches greater at its rear edge than at its front edge.

* * * * *